US005462607A

United States Patent [19]

Mestetsky et al.

[11] Patent Number: 5,462,607

[45] Date of Patent: Oct. 31, 1995

[54] METHOD OF CLEANING USING A FOAMED LIQUID

[75] Inventors: Pat A. Mestetsky, St. Charles; Robert E. Davis, Hinsdale, both of Ill.

[73] Assignee: United Laboratories, Inc., St. Charles, Ill.

[21] Appl. No.: 228,575

[22] Filed: Apr. 15, 1994

[51] Int. Cl.[6] ..... B08B 3/10; B08B 9/00; B08B 9/02; B08B 9/08

[52] U.S. Cl. ..... 134/22.12; 134/22.14; 134/22.19; 134/42

[58] Field of Search ..... 134/22.11, 22.14, 134/22.19, 42, 23.12; 252/174.12, DIG. 12, 547, 528

[56] References Cited

U.S. PATENT DOCUMENTS 3,639,283 2/1972 Crotty ..... 252/529
4,784,790 11/1988 Dish et al. ..... 252/174.12
5,234,832 8/1993 Dish et al. ..... 252/174.12
5,238,609 8/1993 Smith et al. ..... 252/547

FOREIGN PATENT DOCUMENTS 0661825 4/1963 Canada ..... 134/22.14

*Primary Examiner*—Jan H. Silbaugh
*Assistant Examiner*—Zeinab El-Arini
*Attorney, Agent, or Firm*—Andrus, Sceales, Starke & Sawall

[57] ABSTRACT

A method of cleaning industrial equipment by utilizing an ebullated aqueous solution containing a surfactant and enzymes. The aqueous solution is preferably heated in a vessel, such as a batch coker fractionator in an oil refinery, to a temperature sufficient to ebullate or foam the solution and generate a substantial quantity of foam. The surfactant and enzymes are carried by the foam bubbles and transported from the vessel to a contaminated surface outside of the cascading and circulating system of the vessel where the surfactant and enzymes act to remove the contamination.

6 Claims, No Drawings

METHOD OF CLEANING USING A FOAMED LIQUID

BACKGROUND OF THE INVENTION

Many aqueous industrial and household cleaners, such as laundry detergents, contain a mixture of enzymes and surfactants. The enzymes can include one or more of a combination of proteases, amylases, lipases, cellulases and pectinases, and serve to attack or degrade organics, such as grease, oil, or other soil, while the surfactant acts to disperse the degraded particles in the aqueous phase. Surfactants contain both hydrophilic and oleophilic groups, and according to the dispersion mechanism, an oleophilic group on the surfactant will attach to a particle of the oil, grease, or other soil, and pull it into dispersion by attraction of the surfactant's hydrophilic group, for the water with which it is added. The dispersion is maintained by the action of the hydrophilic groups in the surfactant. The hydrophilic groups on different surfactant molecules repel each other, which necessarily results in repulsion between the particles of oil, grease and soil.

Cleaning compositions of this type containing enzymes and a surfactant have been used in the past to remove soiled lubricant from industrial machinery by impinging the aqueous cleaning composition on the surface to be treated through high pressure hoses or jets. Compositions of this type have also been used to clean reactors or other vessels by flowing the composition through the vessels by the action of circulating pumps. To clean oil from ships bilges, the composition containing a surfactant and enzymes has been added to the ship's bilge and the rolling motion of the ships will provide agitation to effectively clean oil and other oleophilic materials from the bilge.

Another method of use in the past has been in cleaning trickling filters in waste water treatment systems, in which the surfactant/enzyme solution is dripped into the influent passing over the filters.

A conventional batch coker fractionator, as found in an oil refinery includes, among its ancillaries, fin fan heat exchanger tubes that are connected to the upper end of the fractionator. While the fractionator itself can be cleaned by cascading a cleaning solution containing surfactants and enzymes through the fractionator column, the fin fan exchanger tubes are not included in the cascading system and in the past have been separately cleaned. As the tubes may contain noxious gases, such as hydrogen sulfide, the initial step, as used in the past, has been to pass an alkaline material, such as sodium hydroxide, through the tubes to react with and remove the hydrogen sulfide gas. After the content of these gases has been reduced, the tubes are subjected to a blast of water under high pressure, in an attempt to loosen the scale and coke from the walls of the tubes. The conventional procedure for cleaning the fin fan exchanger tubes of the fractionator normally requires 2 to 3 days, but the procedure has not been shown to be effective in removing all scale and coke buildup within the tubes. Not only has this procedure been relatively ineffective in removing the deposits from the tubes, but due to the extended time required, there is additional substantial down time for the fractionator.

SUMMARY OF THE INVENTION

The invention is directed to a method of cleaning industrial equipment by contacting the equipment with an ebullated aqueous cleaning solution containing a surfactant and enzymes. The method has particular use in cleaning the overhead fin fan exchanger tubes of a batch coker fractionator in an oil refinery. In use with a fractionator, a quantity of an aqueous cleaning composition containing from 30 to 2500 ppm of a non-ionic water soluble surfactant and from 1 to 200 ppm of enzymes, is introduced into the fractionating column to partially fill the column and provide a headspace above the liquid level. The liquid composition is preferably heated in the vessel to a temperature sufficient to ebullate or foam the liquid, but below the temperature which denatures the enzymes. Heated liquid is withdrawn from the lower end of the fractionator and circulated through an exterior conduit to the upper end of the fractionator where the heated liquid cascades downwardly across the trays of the fractionator to remove oil and other hydrocarbons, as well as coke deposits, from the trays.

Heating the cleaning solution in the fractionator column will ebullate the solution, and due to the presence of the surfactant, large quantities of foam are generated. The foam substantially fills the headspace in the column and passes from the headspace into the fin fan exchanger tubes which were not blended. Unexpectedly it has been found that the surfactant and enzymes in the cleaning solution are transported or carried by the foam into the exchanger tubes. As the foam bubbles move through the tubes, the bubbles burst or collapse and the water, surfactant, and enzymes are deposited on the internal walls of the exchanger tubes. The deposited liquid will flow along the walls of the tubes and attack and remove oil, grease and hydrocarbons that may be present on the tubes. The liquid deposited from the burst foam bubbles will also act to solubilize the binder that binds coke particles together on the tube walls, thereby dislodging the coke from the walls. The dislodged coke particles then flow freely from the tubes.

Heating the solution in the fractionator column increases enzyme activity, and the foam protects the enzymes from being denatured by excessive heat.

The surfactant and enzymes carried by the foam also react with gases, such as hydrogen sulfide, in the exchanger tubes thus eliminating the gases and the odors associated therewith. As the active ingredients in the foam react with the noxious gases, it is not necessary to initially flow a caustic material, such as sodium hydroxide, through the tubes to remove these gases prior to the cleaning process.

The action of the surfactant and enzymes in being transported to the exchanger tubes by the foam is unusual and unexpected. Most industrial cleaning operations utilize an anti-foaming agent to suppress the generation of foam, but here the foam is utilized to carry the active ingredients, i.e. the surfactant and the enzyme, to the tubes which are outside of the circulating or cascading system.

The cleaning of the fin fan exchanger tubes associated with a batch coke fractionator can be accomplished through use of the method of the invention in a period of about 6 to 8 hours, as compared to a time period of 2 to 3 days which was required in the past, using conventional cleaning methods.

While the invention has particular application to cleaning the exchanger tubes in a batch-type coker fractionator, it is contemplated that the method of the invention can also be employed in other applications where direct impingement by a cleaning liquid on the contaminated surfaces is not feasible.

Other objects and advantages will appear in the course of the following description.

DESCRIPTION OF THE PREFERRED EMBODIMENT

According to the invention, contaminated industrial equipment which is outside a normal liquid circulating system can be cleaned by contacting the equipment with a foamed aqueous cleaning composition containing enzymes and preferably containing the combination of enzymes and a surfactant.

The surfactant to be used in the invention is a water-soluble non-ionic type having the following formula:

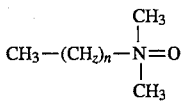

where n is 6 to 20. Specific examples of a surfactant covered by the above formula are lauryl diethylamine oxide, stearyl diethylamine oxide, myristyl diethylamine oxide, and mixtures thereof. The preferred surfactant of this group is lauryl diethylamine oxide.

The enzyme to be used in the invention is selected from the group consisting of proteases, amylases, lipases, cellulases, pectinases, and mixtures thereof.

Preferably, the enzyme is selected from the group consisting of bacterial protease from *Bacillus subtilis*, amylase from *Bacillus subtilis*, lipase from *Aspergillus niger*, cellulase from *Aspergillus niger*, pectinase from *Aspergillus niger*, and mixtures thereof. More preferably, the method of the present invention utilizes an enzyme mixture of protease from *Bacillus subtills*, amylase from *Bacillus subtilis*, lipase from *Aspergillus niger*, cellulose from *Aspergillus niger*, and pectinase from *Aspergillus niger*. A mixture of enzymes of this type is sold by Applied Biochemists, Inc., Milwaukee, Wis. under the trademark "AMERZYME-A-100".

In a preferred method of the invention, as used to clean the tubes of a fin fan exchanger associated with a batch coker fractionator in an oil refinery, a quantity of the liquid cleaning composition is introduced into the fractionator column to partially fill the column and provide a headspace above the liquid level. Steam or other heating medium is introduced into the heating jacket of the fractionator to heat the liquid to a temperature sufficient to ebullate or foam the composition, but below a temperature required to denature the enzymes. In practice, the temperature can be in the neighborhood of 212° F. The heated liquid from the bottom of the fractionator is circulated by a pump through external piping and introduced into the upper end of the fractionator where it cascades downwardly across the fractionator trays, thus cleaning oil and other hydrocarbons, as well as coke deposits, from the trays and the walls of the fractionator.

While the exact mechanism is not fully understood, it is believed that the enzymes attack or degrade the organic materials, such as grease, oil, or other hydrocarbons, while the surfactant disperses the degraded particles in the aqueous phase. As a result, the organic contaminants are removed from the trays.

Heating the cleaning solution in the fractionator column to a temperature of about 212° F. would normally be expected to fractionate or boil off the water, leaving the surfactant and enzymes. However, due to the presence of the surfactant and the lack of an anti-foaming agent, substantial quantities of foam are generated as the solution is heated, and the foam passes into the exchanger tubes which communicate with the upper end of the column. Unexpectedly, it has been discovered that the surfactant and enzymes are transported to the exchanger tubes by the foam bubbles, and as the foam collapses, the water, surfactant and enzymes from the bubble film or skin are deposited on$the walls of the exchanger tubes where the enzymes will attack and degrade the oil and other hydrocarbons, such as benzene, that may be present on the walls of the tubes, and the surfactant acts to disperse the degraded particles in the aqueous phase. It is believed that the liquid deposited on the walls of the tubes will be supported by the foam beneath until the weight of the liquid overcomes the surface tension of the foam bubbles and the liquid will then surge downwardly along the walls of the tubes. This surging of the deposited liquid containing the surfactant and enzymes is repeated and provides a scrubbing action on the tube walls to aid in removing contaminates. In addition, it is believed that the enzymes also will react with gases, such as hydrogen sulfide, that may be present in the tubes, thereby minimizing and/or eliminating the gases and odors that are associated therewith.

Similarly, the active ingredients from the collapsed foam will attack the organic binders that bind the coke particles together on the walls of the exchanger tubes, with the result that the coke particles will be dislodged from the walls.

In a preferred form of the invention, water vapor from the collapsed foam bubbles, after passing through the exchanger tubes, can be condensed and the resulting liquid can then be returned to the fractionator vessel, so that the process results in substantially no loss of the aqueous cleaning composition.

Heating the solution to the above stated temperature increases the enzyme activity, while the foam bubbles carry the enzymes away from the body of heated liquid and protect the enzymes against denaturing.

The following example illustrates the method of the invention.

EXAMPLE I

Approximately 10,400 gallons of an aqueous solution containing 2200 ppm of a surfactant Ammonyx-lo (lauryl diethylamine oxide) and 100 ppm of enzymes (Amerzyme-A-100) were introduced into a batch coker fractionator in the Chevron oil refinery located at Pascagoula, Miss. Artificial piping was constructed to connect the lower end of the fractionator with the upper end.

A furnace line containing the circulating solution was used for heating which resulted in a temperature of 210° F. at the upper end of the fractionator and a slightly higher temperature at the lower end of the fractionator. The heated liquid was circulated through the artificial piping by a pump at the rate of approximately 300 gallons per minute and passed downwardly by gravity across the trays of the fractionator.

Water vapor and foam generated by heating of the liquid passed upwardly from the fractionator column into fin fan tubes of the exchanger connected to the upper end of the column. The fin fan tubes were not blinded. The foam collapsed in the tubes, while the water vapor, after passing through the tubes, was condensed by air cooling. The condensed vapor was then recirculated through external piping to the lower end of the fractionator.

The heating and circulation of the liquid continued for a period of 12 hours. At the end of this period, the heating was terminated and the liquid cleaning composition was drained from the fractionator. The residual cleaning solution, as well as any residual coke particles were then flushed from the fractionator by flowing heated water at a temperature of approximately 180° F. through the fractionator.

A visual inspection, after the cleaning procedure, showed that the fractionator column, as well as the fin fan tubes were substantially free of all coke deposits. Oil and other hydrocarbons, had been substantially removed from the trays of the fractionator, as well as from the exchanger tubes.

Through the method of the invention, coke deposits, as well as hydrocarbons, can be cleaned from the processing equipment that is outside of the circulating path of the liquid. The surfactant and enzymes are transported to the equipment outside of the circulating path by the foam generated by heating of the liquid cleaning composition.

The process, as applied to cleaning fin fan exchanger tubes, requires a substantially shorter time than cleaning processes as used in the past, and thus the overall cost of the cleaning process is reduced, and the downtime for the processing equipment is correspondingly reduced. Further, hydroblasting of the tubes, as required in the past, has been eliminated.

The method of the invention also eliminates toxic gases, such as hydrogen sulfide, from the exchange tubes without the necessity of flowing a caustic material through the tubes prior to the cleaning operation, as has been required in the past.

While the above description has illustrated the cleaning solution being ebullated or foamed by heat and circulation, it is contemplated that the solution can also be foamed, without heat or with reduced heat, by feeding a gas, such as air, nitrogen, or carbon dioxide, into the solution.

Various modes of carrying out the invention are contemplated as being within the scope of the following claims particularly pointing out and distinctly claiming the subject matter which is regarded as the invention.

We claim:

1. A method of removing hydrocarbons and coke deposits for industrial processing equipment, comprising the steps of preparing an aqueous cleaning solution containing from 30 to 2500 ppm of a non-ionic surfactant having the following formula:

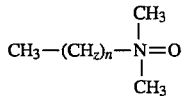

where n is 6 to 20, and 1 to 200 ppm of an enzyme selected from the group consisting of proteases, amylases lipases, cellulases, pectinases, and mixtures thereof, introducing said solution into a vessel having hydrocarbons and coke deposits on walls thereof to partially fill the vessel and provide a headspace in the vessel above a level of said solution, heating the solution in the vessel to an elevated temperature sufficient to ebullate the solution and generate a quantity of foam in said headspace, said foam carrying said surfactant and said enzymes; circulating the heated solution through the vessel to remove the hydrocarbons and coke deposits from the vessel walls, and flowing the foam from the headspace of the vessel into contact with a contaminated surface outside of the vessel to remove hydrocarbons and coke deposits from said surface.

2. The method of claim 1, and including 2 step of collapsing said foam in contact with said surface to deposit said surfactant and enzymes on said surface.

3. A method of cleaning a batch coke fractionator containing hydrocarbon and coke residual deposits, said fractionator including a fractionating vessel and an exchanger tube communicating with an upper end of said vessel, comprising the steps of preparing an aqueous liquid cleaning solution containing 30 to 2500 ppm of a surfactant having the following formula:

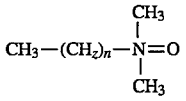

where n is 60 to 20, and 1 to 200 ppm of an enzyme selected from the group consisting of proteases, amylases, lipases, cellulases, pectinases, and mixtures thereof, feeding the solution into the lower end of said fractionating vessel/heating the liquid solution in the vessel to a temperature sufficient to ebullate said solution and generate a substantial quantity of foam containing bubbles carrying said surfactant and said enzymes, withdrawing heated solution from a bottom portion of the vessel and feeding the heated solution into the upper end of said vessel, flowing the heated liquid solution downwardly through the fractionating vessel to thereby remove hydrocarbon and coke deposits from walls of the vessel, and flowing the foam through said exchanger tube to remove hydrocarbons and coke deposits from said tube.

4. The method of claim 3, and including the step of collapsing the foam bubbles in said tube to deposit said surfactant and said enzymes on a wall of the tube.

5. The method of claim 3, wherein said solution is heated to a temperature sufficient to ebullate the solution but below the temperature necessary to denature the enzymes.

6. The method of claim 3, and including the step of maintaining the solution free of anti-foaming agents.

* * * * *

UNITED STATES PATENT AND TRADEMARK OFFICE

CERTIFICATE OF CORRECTION

PATENT NO. : 5,462,607

DATED : October 31, 1995

INVENTOR(S) : PAT A. MESTETSKY

It is certified that error appears in the above-indentified patent and that said Letters Patent is hereby corrected as shown below:

Col. 5, line 37, CLAIM 1, Cancel "for" and substitute therefor ---from---; Col. 6, line 10, CLAIM 2, Cancel "2" before ---step ---; Col. 6, line 31, CLAIM 3, Cancel "vessel/" and substitute therefor ---vessel,---

Signed and Sealed this

Thirteenth Day of August, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,462,607
APPLICATION NO. : 08/228575
DATED : October 31, 1995
INVENTOR(S) : Mestetsky et al.

It is certified that error appears in the above-identified patent and that said Letters Patent is hereby corrected as shown below:

Column 3, lines 12 to 16, column 5, lines 41 to 45, claim 1, and column 6, lines 21 to 25, claim 3, cancel the formula, each occurrence, and insert the following formula for each occurrence:

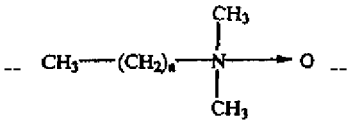

Signed and Sealed this

Seventh Day of July, 2009

John Doll

JOHN DOLL
*Acting Director of the United States Patent and Trademark Office*